US010562171B2

(12) United States Patent
Ohlendorf et al.

(10) Patent No.: US 10,562,171 B2
(45) Date of Patent: Feb. 18, 2020

(54) HAND-HELD POWER TOOL TRANSMISSION CLOSURE AND HAND-HELD POWER TOOL

(71) Applicant: Hilti Aktiengesellschaft, Schaan (LI)

(72) Inventors: Oliver Ohlendorf, Landsberg am Lech (DE); Matthias Keith, Kaufbeuren (DE)

(73) Assignee: Hilti Aktiengesellschaft, Schaan (LI)

( * ) Notice: Subject to any disclaimer, the term of this patent is extended or adjusted under 35 U.S.C. 154(b) by 219 days.

(21) Appl. No.: 15/527,236

(22) PCT Filed: Nov. 20, 2015

(86) PCT No.: PCT/EP2015/077192
§ 371 (c)(1),
(2) Date: May 16, 2017

(87) PCT Pub. No.: WO2016/079284
PCT Pub. Date: May 26, 2016

(65) Prior Publication Data

US 2017/0334057 A1 Nov. 23, 2017

(30) Foreign Application Priority Data

Nov. 21, 2014 (EP) ..... 14194224

(51) Int. Cl.
*B25F 5/02* (2006.01)
*B25D 9/00* (2006.01)
*B25F 5/00* (2006.01)

(52) U.S. Cl.
CPC ..... *B25F 5/02* (2013.01); *B25D 9/00* (2013.01); *B25F 5/008* (2013.01); *B25D 2250/121* (2013.01)

(58) Field of Classification Search
CPC ..... B25F 5/02; B25F 5/008; B25D 2250/121; B65D 51/1611; B65D 51/1655; B65D 51/1644; F16H 57/027
(Continued)

(56) References Cited

U.S. PATENT DOCUMENTS 3,422,982 A * 1/1969 Myers ..... F16H 57/027 220/374
3,693,651 A * 9/1972 Gifford ..... F16K 15/141 137/493
(Continued)

FOREIGN PATENT DOCUMENTS

CN 101949444 1/2011
CN 202176700 3/2012
(Continued)

OTHER PUBLICATIONS

International Search Report of PCT/EP2015/077192, dated Feb. 19, 2016, 1 page.

*Primary Examiner* — Thomas C Diaz
(74) *Attorney, Agent, or Firm* — Davidson, Davidson & Kappel, LLC

(57) ABSTRACT

A hand-held power tool transmission closure having a base body for closing a transmission housing opening of a transmission housing of a hand-held power tool, in particular a hammer drill or a combi-hammer, wherein the hand-held power tool transmission closure includes a tube protruding from the base body, which extends in the transmission housing when the base body closes the transmission housing opening. The hand-held power tool transmission closure includes an air channel which extends in a first air channel section through the base body and in a second air channel section through the tube so that an air mass can flow through the air channel into and out of the transmission housing.

21 Claims, 7 Drawing Sheets

(58) Field of Classification Search
USPC ..... 74/606 A
See application file for complete search history.

(56) References Cited

U.S. PATENT DOCUMENTS

| | | | | |
|---|---|---|---|---|
| 3,866,789 | A * | 2/1975 | Lambert | F16H 57/027 220/303 |
| 4,533,062 | A | 8/1985 | Krautkraemer | |
| 8,360,168 | B2 * | 1/2013 | Kakiuchi | B25D 17/245 173/104 |
| 9,650,926 | B2 * | 5/2017 | Kistner | F16H 57/027 |
| 2007/0251913 | A1 | 11/2007 | Mengeu et al. | |

FOREIGN PATENT DOCUMENTS

| | | | | |
|---|---|---|---|---|
| CN | 202746552 | | 2/2013 | |
| CN | 103291990 | | 9/2013 | |
| CN | 103358287 | | 10/2013 | |
| CN | 203962943 | | 11/2014 | |
| CN | 204491366 | | 7/2015 | |
| DE | 4300441 | C1 * | 12/1993 | F16H 57/027 |
| EP | 0133520 | | 2/1985 | |
| EP | 2433755 | | 3/2012 | |
| GB | 2380442 | | 4/2003 | |

* cited by examiner

HAND-HELD POWER TOOL TRANSMISSION CLOSURE AND HAND-HELD POWER TOOL

The present invention relates to a hand-held power tool transmission closure, which includes a base body for closing a transmission housing opening of a transmission housing of a hand-held power tool, in particular a hammer drill or a combi hammer. The present invention also relates to a hand-held power tool which includes a hand-held power tool transmission closure.

BACKGROUND

A hammer mechanism, including a piston, a connecting rod as well as a striker, may be situated within the transmission housing of a typical hand-held power tool. These are lubricated by a lubricant present in the transmission housing, for example a transmission oil, for the purpose of interacting preferably with little friction. The lubricant is typically introduced into the transmission housing via the transmission housing opening. To prevent the lubricant from exiting the transmission housing, the transmission housing opening is closed by a base body of a hand-held power tool transmission closure. The base body may be designed as a plug.

SUMMARY OF THE INVENTION

It is an object of the present invention to provide an improved hand-held power tool transmission closure, which promotes a longer service life of a hand-held power tool. Another alternate or additional object of the present invention is to provide a hand-held power tool, which includes a hand-held power tool transmission closure improved in this manner.

With regard to the hand-held power tool transmission closure, the present invention provides that the hand-held power tool transmission closure includes a tube protruding from the base body, which extends in the transmission housing when the base body closes the transmission housing opening. The hand-held power tool transmission closure has an air channel, which extends through the base body in a first air channel section and extends through the tube in a second air channel section, so that an air mass is able to flow through the air channel into and out of the transmission housing.

An air mass, which is expanded due to the power tool operation and, in particular, by heating the lubricant present in the transmission housing, is now advantageously able to escape from the transmission housing. Due to the tube according to the present invention protruding from the base body, an undesirable exit of the lubricant from the transmission housing is avoided.

The present invention includes the finding that a lubricant, in particular oil, may not escape from a transmission housing, since the lubricating capacity decreases, on the one hand, and the surface of the power tool visible to the user becomes dirty, on the other hand. The present invention also includes the finding that, due to the closed design of a transmission housing and its closure with the aid of a base body, without an air channel the internal pressure of a transmission housing increases to an undesirably high pressure level during the operation of the power tool. A high pressure level is detrimental to the service life and, in particular, to the performance data, for example the impact energy output by the hand-held power tool. The hand-held power tool transmission closure according to the present invention contributes to the elimination of these disadvantages.

In one preferred embodiment, the tube has an inner diameter between 0.2 mm and 0.8 mm. The inner diameter may be between 0.4 mm and 0.6 mm. It has proven to be particularly advantageous if the inner diameter of the tube is 0.5 mm. Due to an inner diameter selected in this way, a pressure pulsation occurring in the transmission housing during the course of operating the power tool is advantageously effectively attenuated.

For the purpose of improving the temperature stability, it has proven to be advantageous if the tube is made from metal. Alternatively, the tube may be made from a temperature-resistant plastic or similar.

To facilitate an additional safety reserve for a lubricant-free air exchange through the hand-held power tool transmission closure according to the present invention, it has proven to be advantageous if the tube protrudes from the base body in such a way that it ends in the vicinity of a hammer mechanism situated in the transmission housing when the base body closes the transmission housing opening. The tube preferably ends in the vicinity of a connecting rod of the hammer mechanism. The tube may protrude from the base body in such a way that it extends up to the movement axis of the connecting rod without engaging with the range of motion of the connecting rod, i.e., in particular without coming into contact with the connecting rod.

It has proven to be advantageous if the tube is dimensioned, in particular with regard to length, inner diameter and/or angle of protrusion from the base body, in such a way that a capillary rise of lubricant within the tube is avoided. For example, if a typical transmission oil is present within the transmission housing, which has a viscosity of 5 to 20 $mm^2/s$ at 100° C., a density between 850 $kg/m^3$ and 900 $kg/m^3$ at 20° C. as well as a surface tension of 20 to 30 N/m at 100° C., the preferred inner diameter of the tube of 0.5 mm is already sufficiently large to prevent a disadvantageous capillary rise of the transmission oil in the tube.

In one particularly preferred embodiment, the hand-held power tool transmission closure includes a pressure valve situated in the first air channel section. An overpressure occurring in the transmission housing may be decreased via the pressure valve. An underpressure occurring in the transmission housing may preferably be compensated for via the pressure valve.

The pressure valve may be designed as a plate-shaped diaphragm having a central opening, which is preferably situated on a journal, in particular on a centrally situated journal of the base body. This results in a particularly robust and also easily mountable pressure valve. The plate-shaped diaphragm may be made from an elastomer material, a rubber or another elastically deformable material, or it may at least include a material of this type.

The pressure valve may be designed in such a way that it opens only upon exceeding a predetermined pressure difference, for example 2 bar, between the ambient pressure and the transmission pressure. This is advantageous, for example, if the power tool includes an electro-pneumatic hammer mechanism, for which a setpoint overpressure is desirable.

The base body also preferably includes an annular pressure distribution chamber, which is closed by the pressure valve designed as a plate-shaped diaphragm, in particular when the transmission internal pressure and the ambient pressure (air pressure outside the transmission housing) are essentially the same.

In one preferred embodiment, the base body includes a sealing ring, which is situated to seal the base body circumferentially with respect to the transmission housing opening.

The base body is preferably designed as a plug. A plug function of the base body may be implemented, for example, by a sealing ring provided on the base body. Alternatively or additionally, the base body may include ribs which are designed to hold the base body in a transmission housing opening in a force-fitting manner.

With regard to the hand-held power tool the object is achieved in that the hand-held power tool includes a hand-held power tool transmission closure described above.

Further advantages result from the following description of the figures. The figures illustrate different exemplary embodiments of the present invention. The figures, the description and the claims contain numerous features in combination. Those skilled in the art will advantageously also consider the features individually and combine them to form other reasonable combinations.

BRIEF DESCRIPTION OF THE DRAWINGS

In the figures, identical and equivalent components are provided with identical reference numerals.

DETAILED DESCRIPTION

Figure 1:
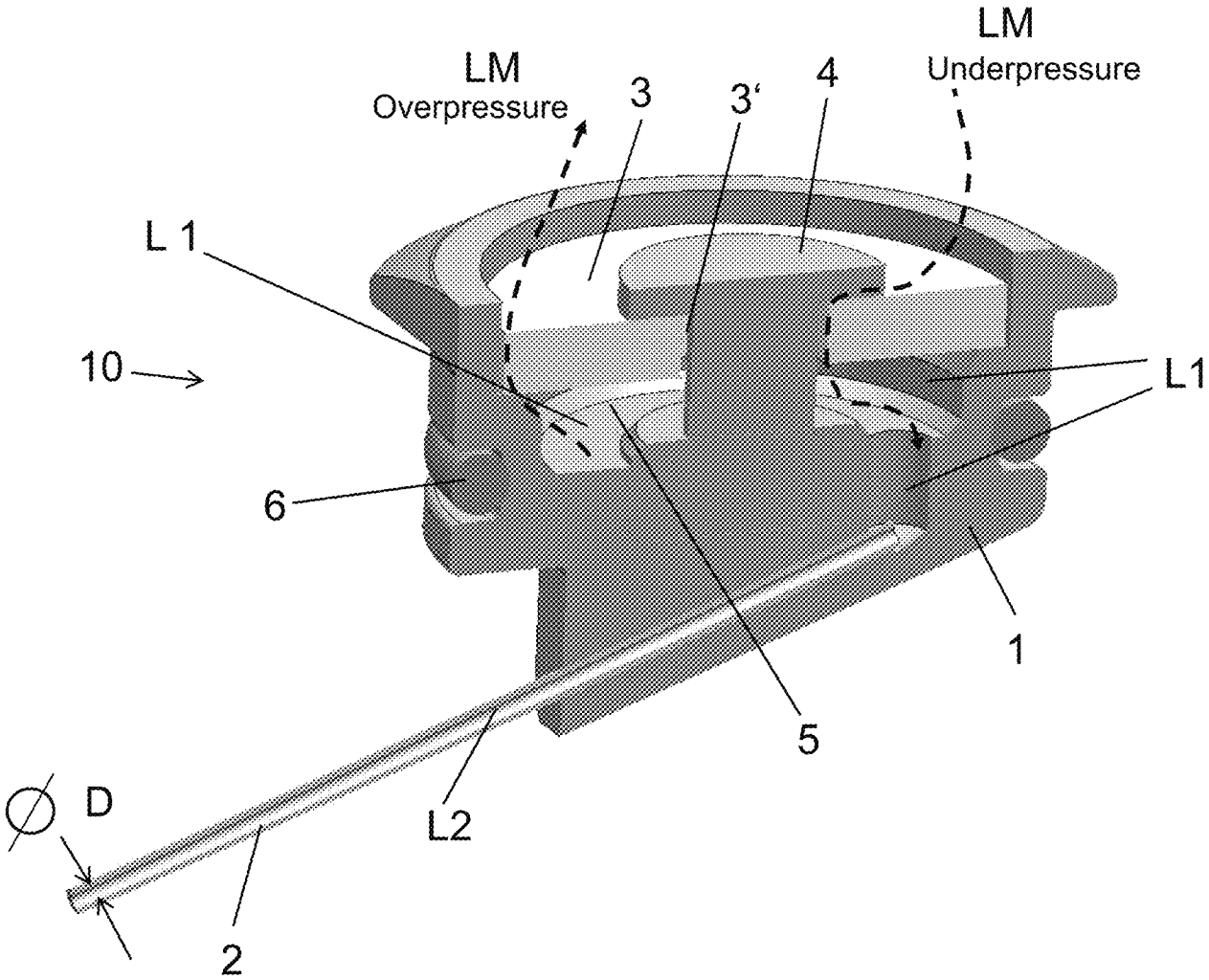
FIG. 1 shows a schematic and perspective representation of a sectional view of a hand-held power tool transmission closure according to the present invention.

A hand-held power tool transmission closure 10 in FIG. 1 includes a base body 1, which is provided to close a transmission housing opening, which is not illustrated. Hand-held power tool transmission closure 10 includes a tube 2 protruding from base body 1, which in the present case is provided as a metal tube. Hand-held power tool transmission closure 10 includes an air channel, which is formed by a first air channel section L1, which extends through base body 1, and by a second air channel section L2, which extends through tube 2. Due to this air channel formed by air channel sections L1, L2, an air mass LM is able to flow into and out of the transmission housing (See FIG. 2).

In the present case, tube 2 has an inner diameter D of 0.5 mm. Since tube 2 protrudes from the underside of base body 1, tube 2 extends within the transmission housing when base body 1 closes a transmission housing opening. A sealing ring 6, which in the present case is made from an elastically deformable rubber, is situated circumferentially on base body 1.

As illustrated in FIG. 1, hand-held power tool transmission closure 10 includes a pressure valve 3 situated in first air channel section L1, which in the present case is designed as a plate-shaped diaphragm having a central opening 3'. Pressure valve 3 designed as a plate-shaped diaphragm is situated on a central journal 4 of base body 1. Base body 1 furthermore includes an annular pressure distribution chamber 5, which is closed by pressure valve 3 designed as a plate-shaped diaphragm.

Due to pressure valve 3, an air mass LM may escape from the transmission housing, which is illustrated by the dashed line with arrow pointing away from base body 1. Moreover, an air mass LM is able to enter the transmission housing, from the transmission surroundings via pressure valve 3, which is indicated by the dashed line with arrow pointing in the direction of tube 2. The pressure regulating function of pressure valve 3 is explained in greater detail farther below with reference to FIGS. 4 through 6.

Figure 2:
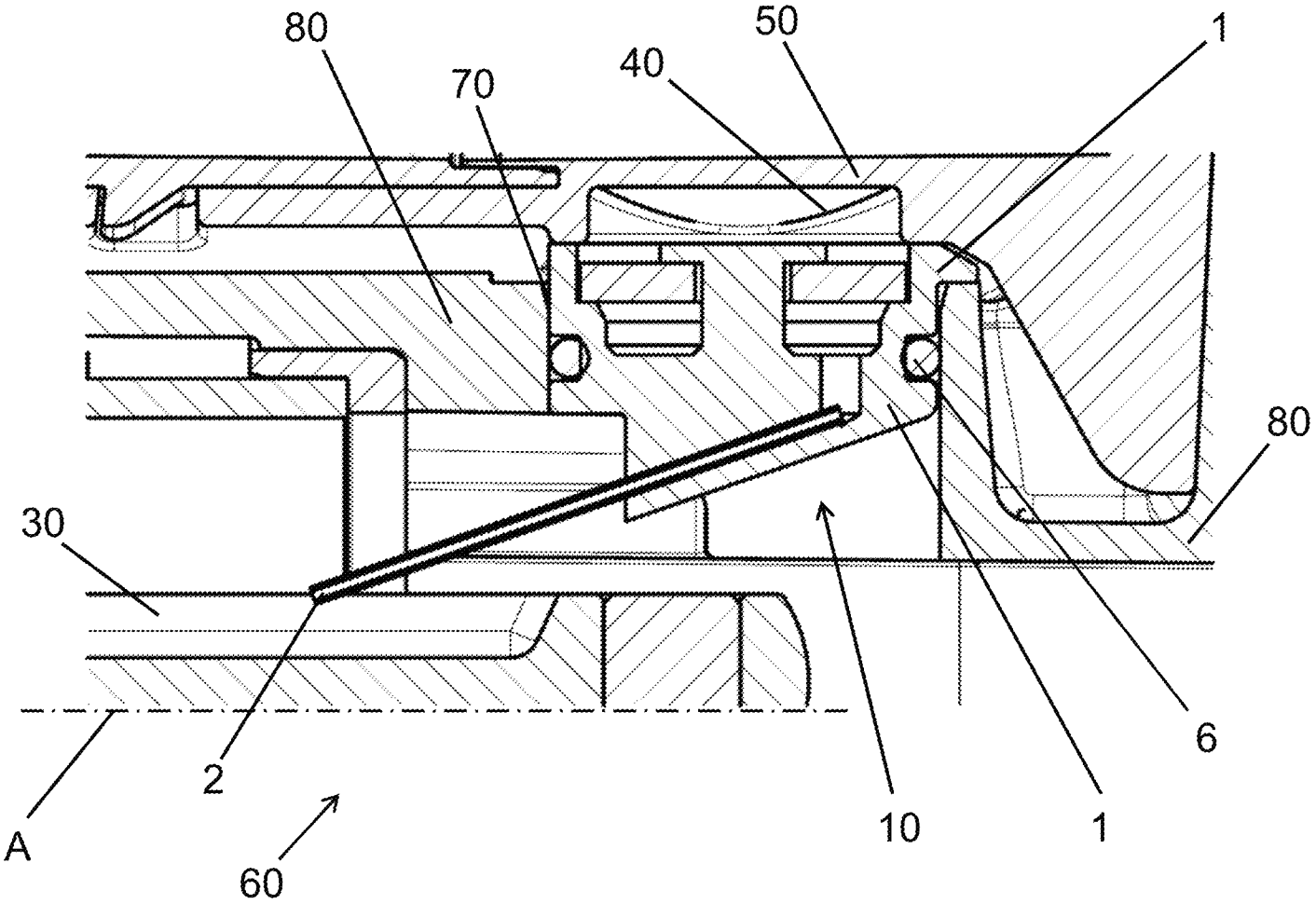
FIG. 2 shows a schematic representation of the hand-held power tool transmission closure from FIG. 1, which closes a transmission housing opening.

FIG. 2 shows a hand-held power tool transmission closure 10, which closes a transmission housing opening 70 of a transmission housing 80. Base body 1 of hand-held power tool transmission closure 10 is held in transmission housing opening 70 by a circumferentially running sealing ring 6 and held in its position by a leaf spring 40 situated below an oscillation plate 50.

As is also apparent from FIG. 2, tube 2 protrudes from base body 1 in such a way that tube 2 ends in the vicinity of a connecting rod 30 of hammer mechanism 60. More specifically, tube 2 protrudes from base body 1 in such a way that it extends up to movement axis A of connecting rod 30 without engaging with the range of motion of connecting rod 30, i.e., in particular without coming into contact with connecting rod 30—regardless of a particular connecting rod length. Due to the installation situation shown in FIG. 2, an air exchange of transmission housing 80 is achieved without a lubricant being able to escape therefrom.

Figure 3:
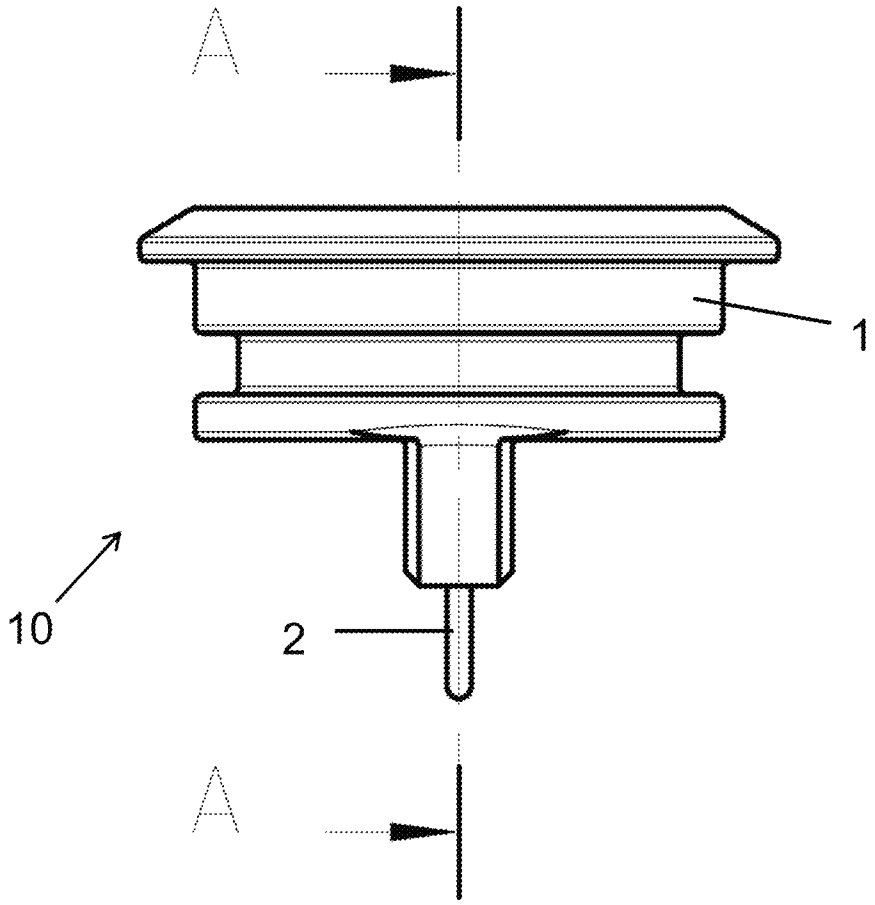
FIG. 3 shows a schematic representation of the hand-held power tool transmission closure from FIG. 2, viewed from the rear and with a plotted intersection line A-A.

FIG. 3 shows hand-held power tool transmission closure 10, including base body 1 and tube 2 protruding from the underside, a rear view of hand-held power tool transmission closure 10 being illustrated in FIG. 3 (viewed from the right with respect to FIG. 2). An intersection line A-A is plotted in FIG. 3, whose section A-A is explained in greater detail below with reference to FIG. 4.

Figure 4:
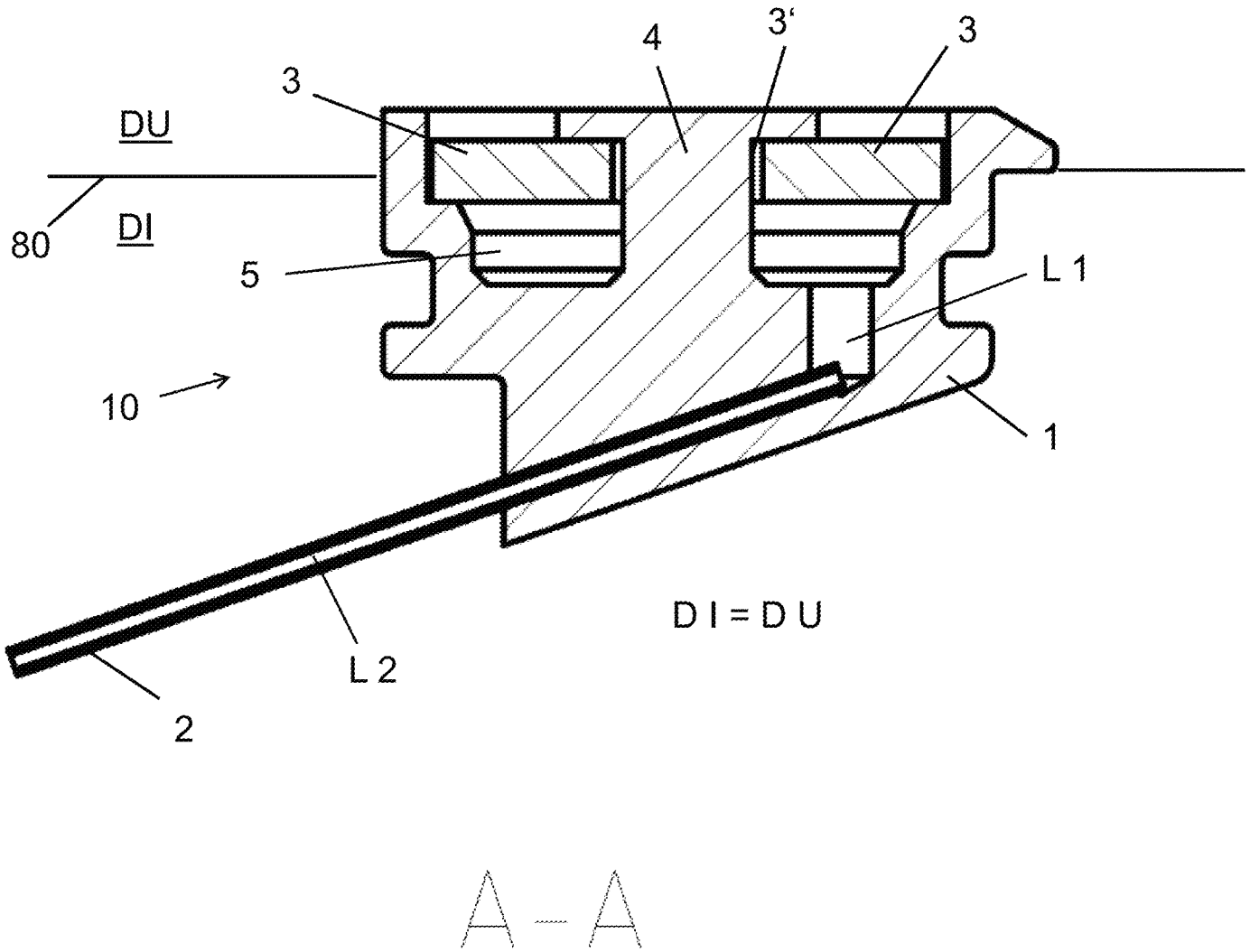
FIG. 4 shows a schematic sectional representation of the hand-held power tool transmission closure according to intersection line A-A from FIG. 3, when the transmission internal pressure and the ambient pressure are essentially the same.

Section A-A illustrated in FIG. 4 shows hand-held power tool transmission closure 10 in its state when transmission internal pressure DI within transmission housing 80 and ambient pressure DU outside transmission housing 80 are essentially the same. Pressure valve 3 designed as a plate-shaped diaphragm rests on journal 4 of base body 1 in the undeflected state. No air exchange takes place via first and second air channel sections L1, L2 and via pressure valve 3. This is the case, for example, when the hand-held power tool has not been in operation for a long period of time or if a pressure compensation has already occurred during the operation of the hand-held power tool.

Figure 5:
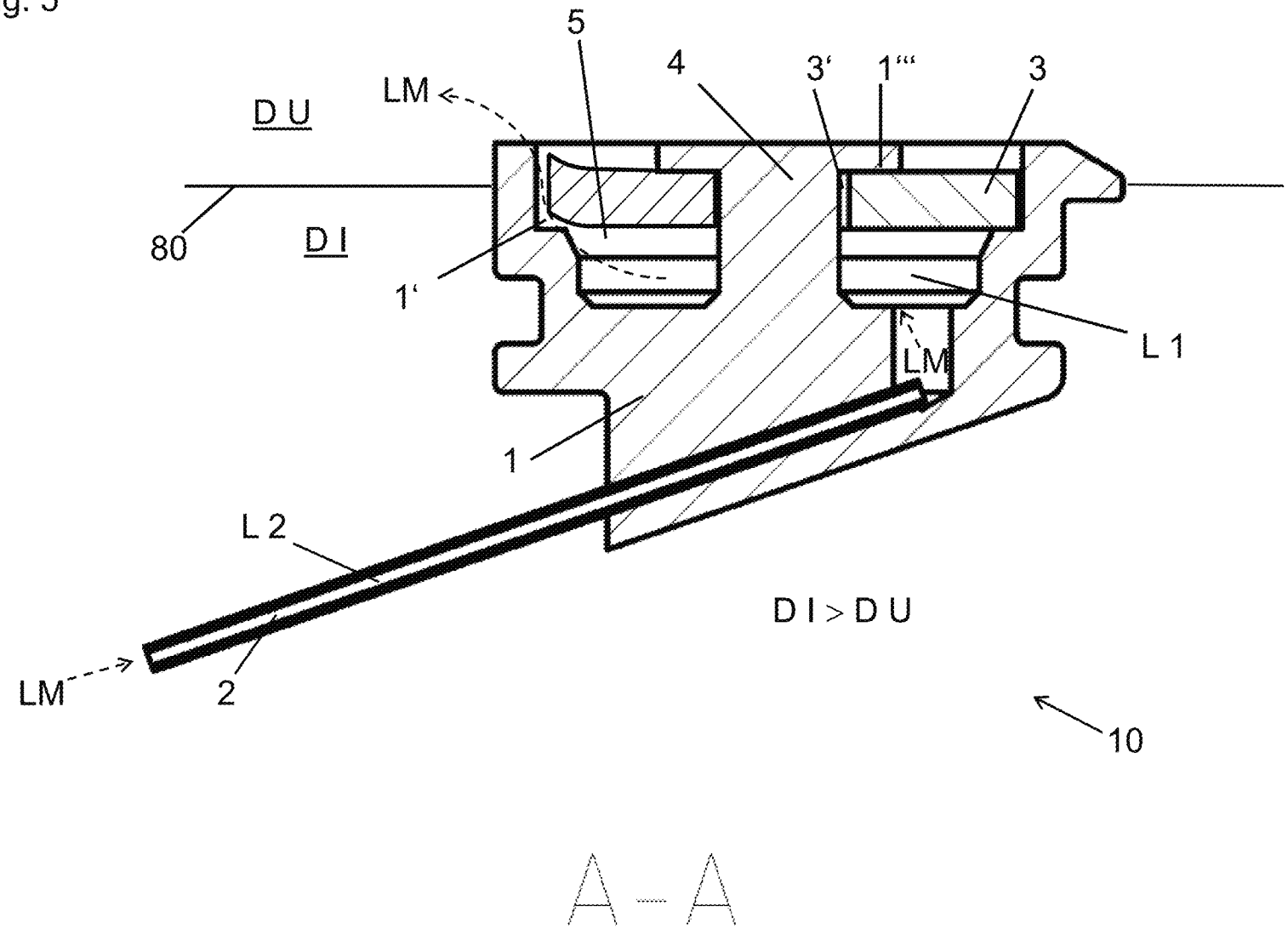
FIG. 5 shows a schematic sectional representation of the hand-held power tool transmission closure according to intersection line A-A from FIG. 3, when the transmission internal pressure exceeds the ambient pressure.

FIG. 5 shows the state of hand-held power tool transmission closure 10 when transmission internal pressure DI exceeds ambient pressure DU, i.e., when an overpressure prevails in the transmission housing. This is the case, for example, when the hammer mechanism has heated a lubricant present in the transmission housing. An air mass LM flows into tube 2 protruding from base body 1 according to the dashed line with arrow and moves along air channel section L2 defined by tube 2 in the direction of base body 1. From there, air mass LM enters pressure distribution chamber 5 according to the dashed line with arrow, pressure distribution chamber 5 being situated in first air channel section L1 of base body 1. Due to an elastic deflection of pressure valve 3 provided as a plate-shaped diaphragm, air mass LM may escape from base body 1 on its upper side. As is also apparent from FIG. 5, pressure valve 3 designed as a plate-shaped diaphragm is lifted off of a first valve seat 1' situated on the outer circumference of base body 1. After a pressure compensation has taken place, pressure valve 3 returns to its initial position shown in FIG. 4.

Figure 6:
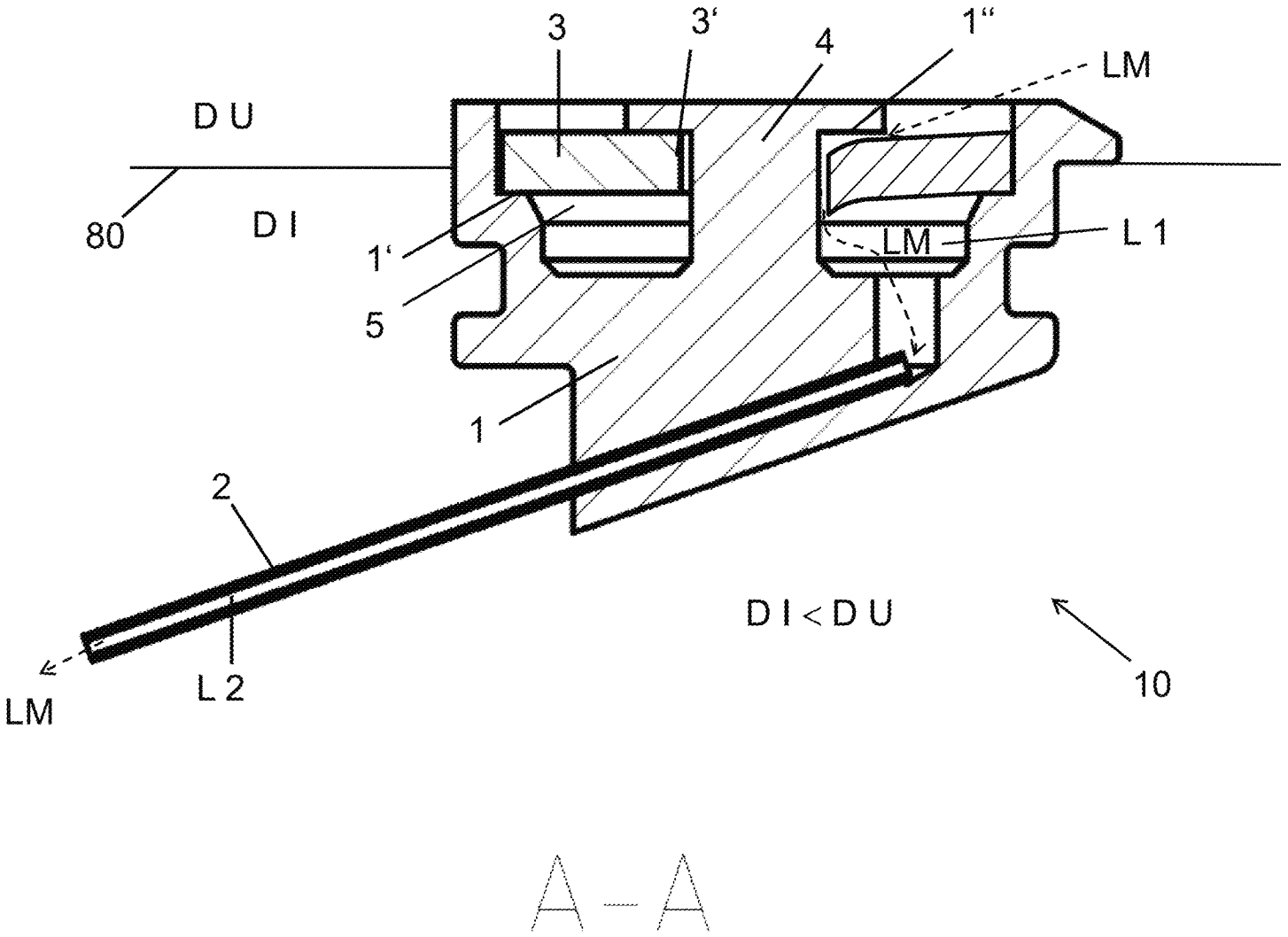
FIG. 6 shows a schematic sectional representation of the hand-held power tool transmission closure according to intersection line A-A from FIG. 3, when the transmission internal pressure drops below the ambient pressure.

FIG. 6 now shows the state of hand-held power tool transmission closure 10 when transmission internal pressure DI drops below ambient pressure DU, i.e., when an underpressure prevails in transmission housing 80. This is the case, for example, when the hammer mechanism cools after a power tool operation. An air mass LM indicated by the dashed line with arrow may flow into annular pressure distribution chamber 5 on the upper side of base body 1 via pressure valve 3 designed as a plate-shaped diaphragm. Pressure valve 3 designed as a plate-shaped diaphragm lifts off of a second valve seat 1", which is situated on central journal 4 of base body 1. As indicated by the dashed line with arrow during the further progression, air mass LM flows further through base body 1 along first air channel section L1 until it reaches tube 2 protruding into air channel section L2 of base body 1 for the purpose of exiting tube 2 at its end, as illustrated by the dashed line with arrow. After a pressure compensation has taken place, pressure valve 3 returns to its initial position shown in FIG. 4.

Figure 7:
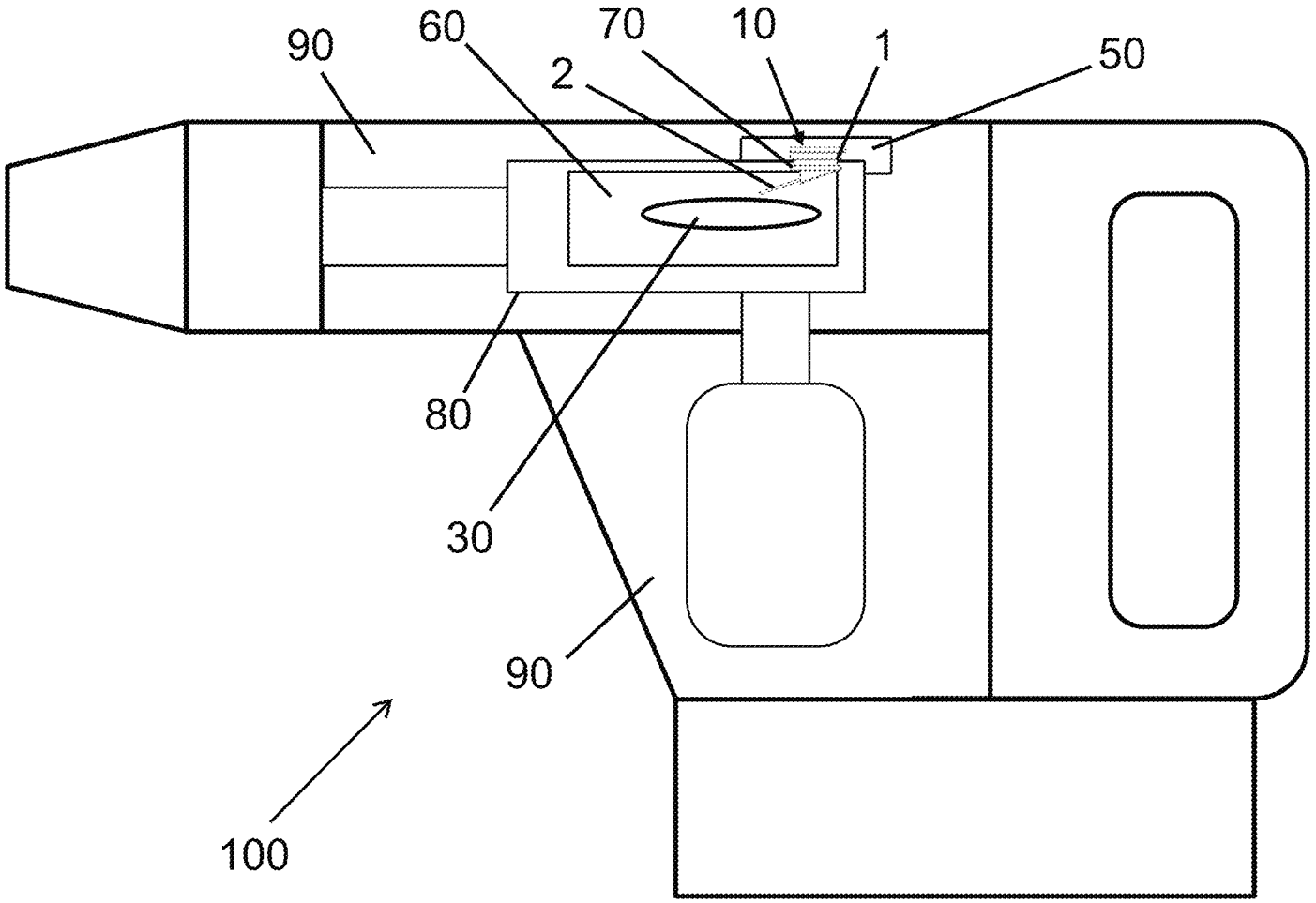
FIG. 7 shows a schematic illustration of a hand-held power tool, including a hand-held power tool transmission closure according to the present invention.

A hand-held power tool 100 is illustrated in FIG. 7. This hand-held power tool includes a power tool housing 90, which surrounds a transmission housing 80. A hammer mechanism 60, including a connecting rod 30, is situated within transmission housing 80. Hand-held power tool transmission closure 10 is situated in a transmission housing opening 70 and is covered on the upper side by an oscillation plate 50 of hand-held power tool 100. Tube 2 protruding from base body 1 of hand-held power tool transmission closure 10 ends in the vicinity of connecting rod 30 of hammer mechanism 60. Due to tube 2 protruding from base body 1, an undesirable exit of the lubricant from transmission housing 80 is avoided.

LIST OF REFERENCE NUMERALS

D inner diameter of the tube
DI transmission internal pressure
DU ambient pressure
L1 first air channel section
L2 second air channel section
LM air mass
1 base body
1' first valve seat
1" second valve seat
2 tube
3 pressure valve
3' central opening
4 central journal
5 pressure distribution chamber
6 sealing ring
10 hand-held power tool transmission closure
30 connecting rod
40 leaf spring
50 oscillation plate
60 hammer mechanism
70 transmission housing opening
80 transmission housing
90 power tool housing
100 hand-held power tool

What is claimed is:

1. A hand-held power tool comprising:

a transmission housing having a transmission housing opening;

a transmission closure comprising: a base body closing the transmission housing opening; a tube protruding from the base body and extending into the transmission housing; and an air channel extending through the base body in a first air channel section and extending through the tube in a second air channel section, so that an air mass is able to flow through the air channel into and out of the transmission housing;

an oscillation plate covering the transmission closure; and a spring situated below the oscillation plate and connected to the base body.

2. The hand-held power tool as recited in claim 1 wherein the tube has an inner diameter between 0.2 mm and 0.8 mm.

3. The hand-held power tool as recited in claim 2 wherein the tube has an inner diameter of 0.5 mm.

4. The hand-held power tool as recited in claim 1 wherein the tube protrudes from the base body in such a way that the tube ends at a hammer mechanism situated within the transmission housing.

5. The hand-held power tool as recited in claim 4 wherein the tube ends at a connecting rod of the hammer mechanism.

6. The hand-held power tool as recited in claim 1 further comprising a pressure valve situated in the first air channel section, an overpressure occurring in the transmission housing being decreasable via the pressure valve.

7. The hand-held power tool as recited in claim 6 wherein an underpressure occurring in the transmission housing is compensatable via the pressure valve.

8. The hand-held power tool as recited in claim 6 wherein the pressure valve is designed as a plate-shaped diaphragm having a central opening situated on a journal of the base body.

9. The hand-held power tool as recited in claim 8 wherein the base body includes an annular pressure distribution chamber closed by the plate-shaped diaphragm when the transmission internal pressure and the ambient pressure are the same.

10. The hand-held power tool as recited in claim 1 wherein the base body includes a sealing ring situated to seal the base body circumferentially with respect to the transmission housing opening.

11. The hand-held power tool as recited in claim 1 wherein the base body is designed as a plug.

12. The hand-held power tool as recited in claim 1 further comprising:

a power tool housing enclosing the transmission housing.

13. A hammer drill or a combi hammer comprising the hand-held power tool as recited in claim 12.

14. The hand-held power tool as recited as recited in claim 1 wherein the spring is a leaf spring.

15. The hand-held power tool as recited as recited in claim 14 wherein the leaf spring is concave with respect to the oscillation plate and convex with respect to the base body.

16. The hand-held power tool as recited as recited in claim 1 wherein a longitudinal axis of the tube is angled with respect to a planar top surface of the base body.

17. The hand-held power tool as recited in claim 1 wherein the transmission housing houses a hammer mechanism.

18. The hand-held power tool as recited in claim 1 wherein the base body is located in the opening.

19. The hand-held power tool as recited in claim 1 wherein the tube extends through base body.

20. A hand-held power tool comprising:

a transmission housing having a transmission housing opening;

a transmission closure comprising: a base body closing the transmission housing opening; a tube protruding from the base body and extending into the transmission housing; and an air channel extending through the base body in a first air channel section and extending through the tube in a second air channel section, so that an air mass is able to flow through the air channel into and out of the transmission housing;

a pressure valve situated in the first air channel section, an overpressure occurring in the transmission housing being decreasable via the pressure valve;

wherein the pressure valve is designed as a plate-shaped diaphragm having a central opening situated on a journal of the base body.

21. The hand-held power tool as recited in claim 20 wherein the base body includes an annular pressure distribution chamber closed by the plate-shaped diaphragm when the transmission internal pressure and the ambient pressure are the same.

* * * * *